US006338335B1

(12) United States Patent
Patterson et al.

(10) Patent No.: US 6,338,335 B1
(45) Date of Patent: Jan. 15, 2002

(54) THROTTLE BODY SPACING BLOCK WITH CONTINUOUSLY GROOVED APERTURE(S) FOR INTERNAL COMBUSTION ENGINES

(76) Inventors: Larry Patterson, 356 Tanner Rd.; Jerry Brown, 409 Tanner Rd., both of Searcy, AR (US) 72143

( * ) Notice: Subject to any disclaimer, the term of this patent is extended or adjusted under 35 U.S.C. 154(b) by 0 days.

(21) Appl. No.: 09/517,220

(22) Filed: Mar. 2, 2000

Related U.S. Application Data

(60) Provisional application No. 60/157,644, filed on Oct. 4, 1999.

(51) Int. Cl.[7] ..... F02M 29/06
(52) U.S. Cl. ..... 123/590
(58) Field of Search ..... 123/590, 337, 123/592

(56) References Cited

U.S. PATENT DOCUMENTS 2,639,230 A * 5/1953 Lefebre ..... 123/590
4,086,899 A * 5/1978 Gaylord ..... 48/189.4
4,274,386 A * 6/1981 Reyes ..... 123/591
4,711,225 A * 12/1987 Holderle et al. ..... 123/590
5,632,145 A * 5/1997 Hunt ..... 60/323
5,924,398 A * 7/1999 Choi ..... 123/184.21
5,947,081 A * 9/1999 Kim ..... 123/306
6,073,609 A * 6/2000 Buswell et al. ..... 123/306

* cited by examiner

*Primary Examiner*—Willis R. Wolfe
*Assistant Examiner*—Hai Huynh

(57) ABSTRACT

A spacing block (12) having the grooved aperture(s) (10) that manipulate the incoming air charge of internal combustion engines for which it is retrofitted. The grooved aperture (10) consists of an opening of a minor diameter with a helical shape having a 45 degree slope and a flat bottom major diameter spaced at approximately 0.25" itch diameter. This creates a 45 degree screw pitch through the thickness of spacing block (12). At the top and bottom of grooved aperture (10) consists of two chambers of 45 degrees starting at the major diameter and ending at the minor diameter of the helical shape.

4 Claims, 3 Drawing Sheets

THROTTLE BODY SPACING BLOCK WITH CONTINUOUSLY GROOVED APERTURE(S) FOR INTERNAL COMBUSTION ENGINES

CROSS REFERENCES TO RELATED APPLICATIONS

This application claims the benefit of Provisional Patent Application Ser. No. 60/157,644 filed Oct. 4, 1999.

BACKGROUND—FIELD OF INVENTION

This invention relates to a throttle body spacing block for any and all internal combustion engines, specifically an incorporation of specially designed grooves located within the aperture(s) of the throttle body spacing block, that improves internal combustion engine performance as in increased gas mileage, lower fuel emissions, increased horse power and torque.

BACKGROUND—DESCRIPTION OF PRIOR ART

The use of throttle body spacing blocks, or throttle body spacing blocks, is well known in the prior art. In fact, throttle body spacing blocks are frequently found in the automotive part after-market.

Popular use of throttle body spacing blocks on today's automotive parts after-market is for improved automotive performance. Such throttle body spacing blocks are used to separate the existing throttle body, throttle body injection unit and/or carburetor from the intake manifold of an internal combustion engine found in automobiles. The increased space allows the incoming air charge to increase velocity prior to entering the combustion chamber of the engine. The increased air velocity serves to improve the efficiency of the internal fuel combustion. The throttle body spacing blocks heretofore devised and utilized for the purpose of a throttle body spacing block are known to consist basically of familiar, expected, and obvious structural configurations, notwithstanding the vast array of designs for any and all internal combustion engines encompassed by the crowded prior art that has been developed for the fulfillment of countless objectives and requirements.

As stated, the use of a form of the throttle body spacing block in an automobile is varied. By way of example, U.S Pat. No. 4,415,507 to Voliva discloses a throttle body spacing block that incorporates a mixing valve for a fuel carburetor. U.S. Pat. No. 4,215,663 to Gaylord discloses an air fuel inlet device located within a throttle body spacing block for an internal combustion engine. U.S. Pat. No. 4,667,648 to Beldin discloses a vaporizing within a throttle body spacing block. U.S. Pat. No. 4,043,306 to Abbott discloses a carburetor throttle body spacing block with a vapor fuel inlet. U.S. Pat. No. 4,086,899 to Gaylord discloses an air inlet device for an internal combustion engine. U.S. Pat. No. 5,619,960 to Funk is a throttle body spacing block kit consisting of the throttle body spacing block itself, gaskets, and bolts for attaching said block to the internal combustion engine's intake manifold.

The above designs and uses of the throttle body spacing block differ substantially from the present invention.

Of the above, U.S. Pat. No. 4,086,899 to Gaylord and U.S. Pat. No. 4,215,663 to Gaylord along with U.S. Pat. No. 5,619,960 to Funk, though differing substantially from the present invention, reflect a similar purpose. The purpose is to improve automobile engine performance and efficiency such as: decreased fuel consumption, decreased exhaust emissions, increased horsepower and increased torque. These aims are achieved by improving the most basic action of any and all internal combustion engines, the actual combustion of fuel. Combustion is most efficient when fuel is fully mixed with air. U.S. Pat. No. 4,086,899 to Gaylord; U. S. Pat. No. 4,215,663 to Gaylord; U. S. Pat. No. 5,619,960 to Funk each use a throttle body spacing block to increase air velocity or use of an air-fuel inlet within the throttle body spacing block to effect this purpose of improved fuel combustion.

Specifically, U.S. Pat. No. 5,619,960 Funk relates to a throttle body spacing block that was designed to go underneath the throttle body injection unit of a V6 or V8 engine of most GM engine products. The throttle body spacing block itself contained two apertures, or openings, through which air would travel. However, embodiment was not limited to a throttle body spacing block with two apertures. Further, the spacer raised the throttle body injection unit off the intake manifold approximately 1.25". As previously explained, this extra height caused the air flowing through the throttle body injection unit to increase velocity with said increased velocity serving to atomizes the fuel which, in turn, creates an efficient internal combustion with the engine.

The present invention differs substantially in its design and function of prior throttle body spacing blocks. The apertures found in the throttle body spacing block described above in Funk, are smooth, or a plain surface. The incoming air charge passes through these-apertures into the intake manifold. The increased distance created by the spacing plate allows the incoming air charge to increase velocity as it enters into the intake manifold. Therefore, the throttle body spacing block only provides "extra" space which allows the incoming air charge to increase velocity through inertia.

The main disadvantages of all throttle body spacing blocks heretofore known are evident from their design. Notably, the now standard use of fuel injection technology and dry air manifolds eliminate the need for air-inlet devices as found in U.S. Pat. No. 4,086,899 to Gaylord and U.S. Pat. No. 4,215,663 to Gaylord as they were developed for use in the then prevalent wet manifolds. U.S. Pat. No. 5,619,960 to Funk provides no means by which to either directly increase the velocity of the air charge or to turbinate the air charge. Further, the prior art provides no means by which to either directly increase the velocity of the air charge or to turbinate the air charge. Most importantly, the prior art dramatically limits its scope of use for automobiles only.

However, based on the prior art, the present invention substantially departs from the conventional concepts and designs of the prior art in scope and in function, and in doing so provides an apparatus primarily developed for the purpose of increasing gas mileage, increasing horse power, increasing torque, and reducing emissions for any and all internal combustion engines. Additionally, the present invention does not limit its scope of application to automobiles. Specifically, the present invention can be retrofitted for any and all internal combustion engines.

Thus, there is an apparent need for an improved throttle body spacing block that can increase gas mileage, increase horsepower, increase torque, and reduce emissions. Based upon these qualities, the present invention substantially fulfills these needs.

REFERENCE NUMERALS

10 aperture

12 spacing block

Summary Including Objects and Advantages

SUMMARY

Figure 1:
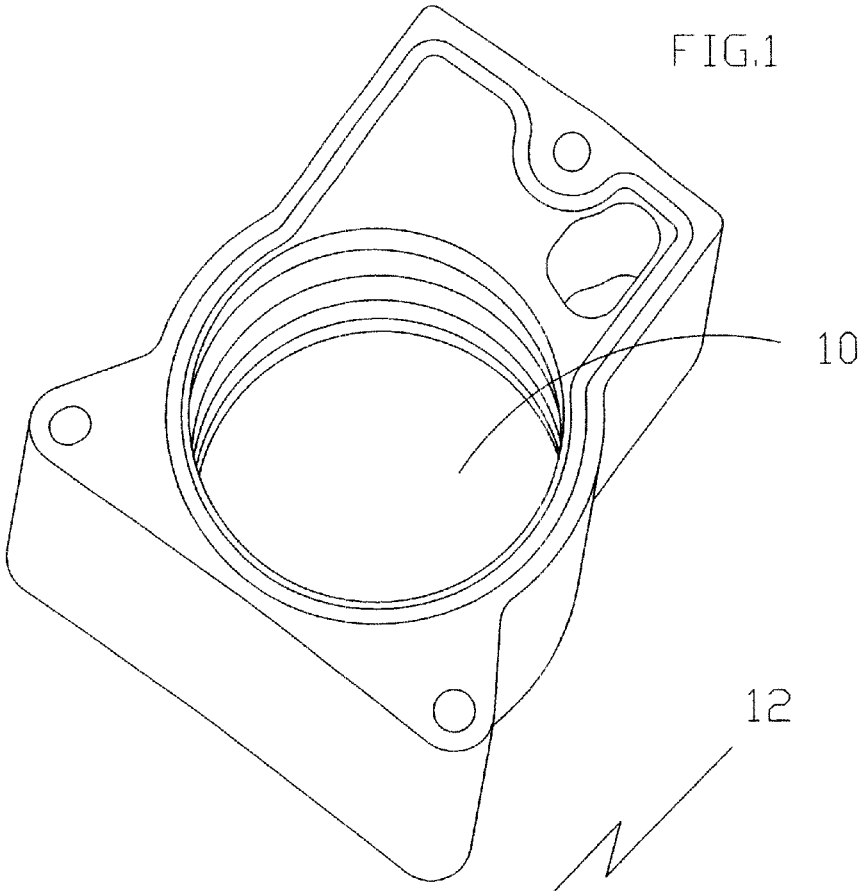
FIG. 1 is a perspective view sheet 1 of 3 of an example spacing block, constructed of aluminum showing principals of the invention.
Figure 2:
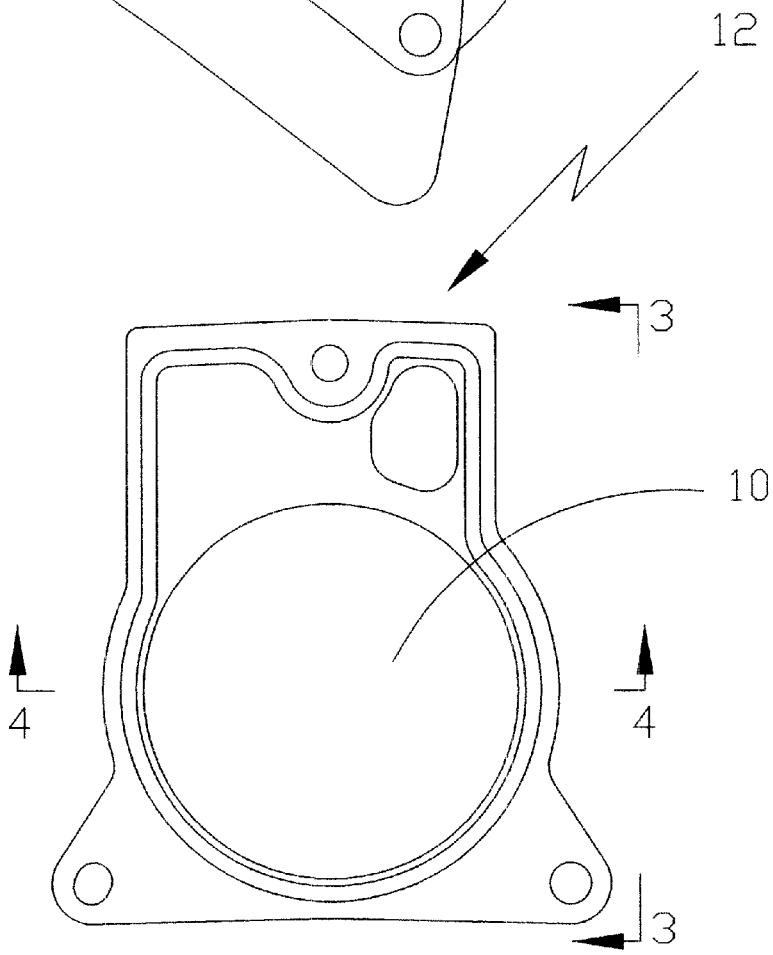
FIG. 2 is a plane view sheet 1 of 3 of a typical spacing block with present invention.
Figure 3:
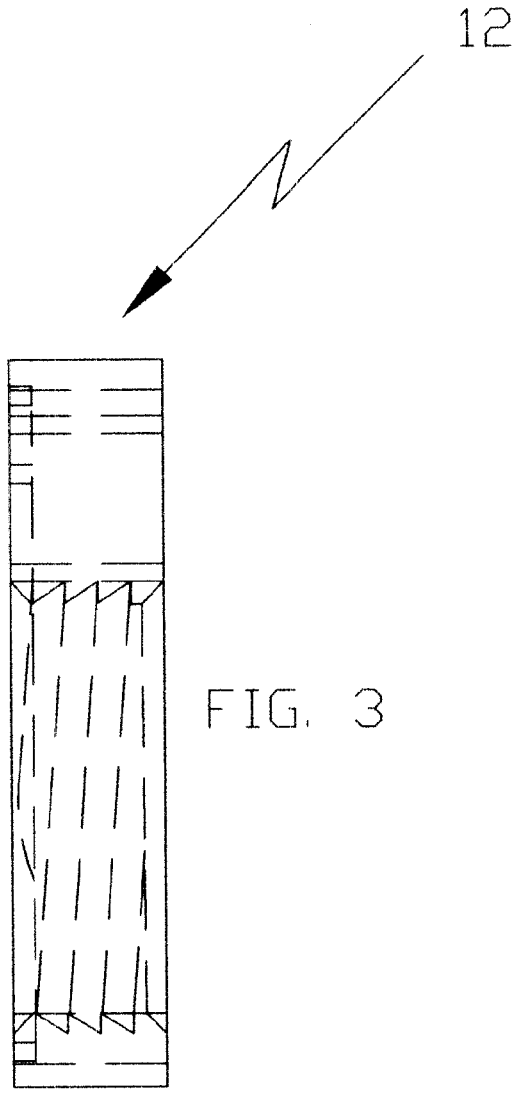
FIG. 3 is a side view of spacing block example 12 sheet 2 of 3 taken from view 3—3 of sheet 1 of 3.

The present invention contemplates a throttle body spacing block fitted and designed for an internal combustion engine with aperture(s) incorporating the specially designed grooves. Said aperture(s) having a minor diameter with a helical shape having a 45 degree slope and a flat bottom major diameter spaced at 0.25" pitch diameter. Further, said aperture(s) having a 45 degree chamber with a diameter 0.200 larger than the through bore.

OBJECTS AND ADVANTAGES

Accordingly, besides the objects and advantages of the throttle body spacing block plate with the specially designed grooved aperture(s) described above, several objects and advantages of my invention are:

An object of the present invention is to provide a new and improved throttle body spacing block for any and all internal combustion engines which has all of the advantages of the prior art spacing blocks and none of the disadvantages;

An object of the present invention to provide new and improved spacing block for any and all internal combustion engines which may be easily and efficiently manufactured and marketed;

An object of the present invention to provide new and improved spacing block for any and all internal combustion engines which are of a durable and reliable constructions;

An object of the present invention is to provide a new and improved spacing block for any and all internal combustion engines which are susceptible of a low cost of manufacture with regard to both labor and materials, and which accordingly are then susceptible of low prices of sale to the consuming public, thereby making such throttle body spacing block economically available to the buying public;

An object of the present invention is to provide new and improved throttle body spacing block for any and all internal combustion engines which provide the apparatuses and methods of the prior art with some of the advantages thereof, while simultaneously overcoming some of the disadvantages normally associated therewith;

An object of the present invention to increase gas mileage, increase horse power, increase torque, and reduce emissions; and An object of the present invention is to provide a new and improved throttle body spacing plate applicable to any and all internal combustion engines which is adapted to be interconnected to the intake manifold of an internal combustion engine. The present invention with its specially designed grooved aperture(s) act to increase the distance the incoming air charge travels before it enriches the fuel mixture and to cause the incoming air charge to turbinate thereby creating an air vortex. These two effects, the increased distance traveled and the air vortex, act to effect higher air velocity and air turbulence. This, in turn, creates a more oxygenated fuel supply. A more oxygenated fuel supply creates more efficient fuel combustion.

The present invention is also described in terms of a throttle body spacing block that enables retrofitting the throttle body spacing block upon the existing intake manifolds of any and all internal combustion engines.

Still further objects and advantages will become apparent from a consideration of the ensuing description and accompanying drawings.

Preferred Embodiment—Description

With reference to the drawings, the aperture 10 provides the principal concept of the invention.

Figure 4:
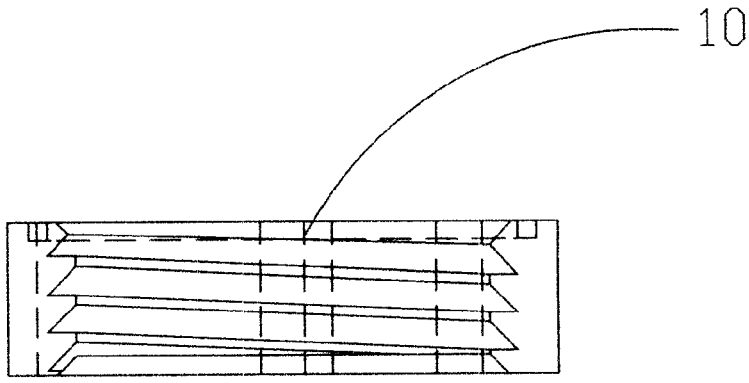
FIG. 4 is a section view of spacing block example 12 sheet 2 of 3 taken from view 4—4 of sheet 1 of 3.
Figure 5:
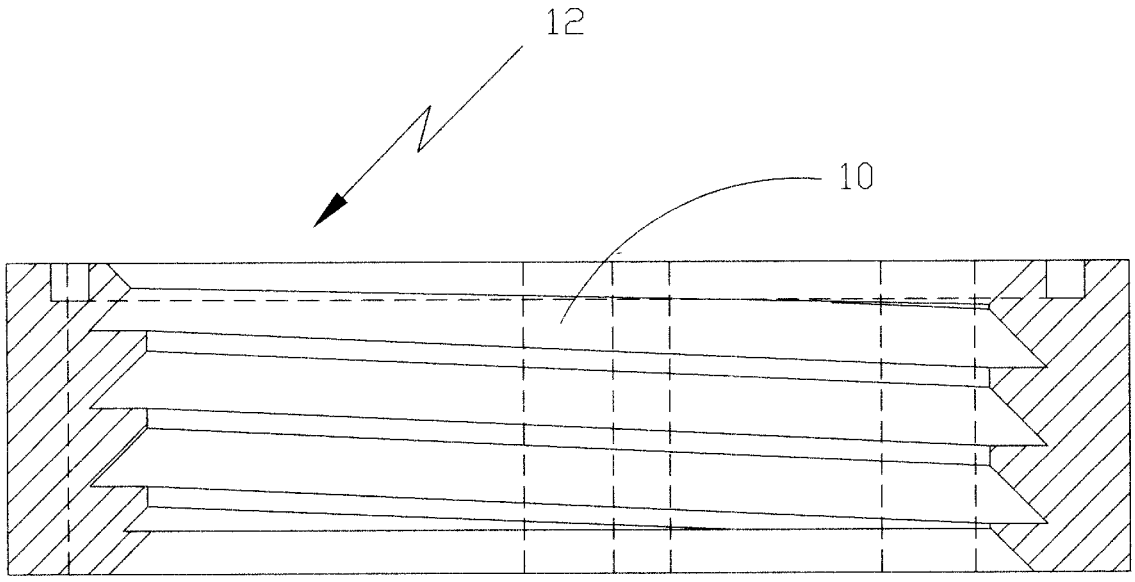
FIG. 5 is an enlarged section view of FIG. 4 sheet 2 of 3 to give more detail to present invention with consideration given to the example spacing block 12 which may vary in shape and thickness determined by intake manifold and engine specifications.

The spacing block 12, as an example, is constructed of billet aluminum that may vary from approximately 0.75" to 1.00' in thickness. Length and width will vary depending on application. The spacing block 12 has a defined upper and lower surface with a variable peripheral edge and hole pattern depending on the retrofit. The airflow opening 10 may consist of one or more apertures. The intake example, aperture 10, consists of a through hole having a minor diameter with a helical shape having a 45 degree slope and a flat bottom major diameter spaced at approximately 0.25" pitch diameter. Upper and lower surfaces of FIG. 4 aperture 10 consists of two chambers of 45 degrees starting at the major diameter and ending at the minor diameter of the helical shape. Preferably the upper surface major diameter of the chamber is the same diameter as the throttle body, throttle body injection, carburetor intake diameter of an internal combustion engine.

When installed using a gasket form or required manufacturer's service gasket or gaskets, the spacing block serves to separate the throttle body, throttle body injection unit, and carburetor an achieved distance from the intake manifold. The application depends on the design of the intake manifold, throttle body, throttle body injection and/or carburetor. In other words, the spacing block can be designed per the application, however; the grooved design of the aperture is universal to all applications.

Utilizing existing or purchased hardware, the spacing block 12 will be positioned using existing mounting holes of an intake manifold for an internal combustion engine.

Preferred Embodiment—Operation

As to the manner of usage and operation of the present invention, the same should be apparent from the above description. Specifically, but not limited to, the grooved surface of the throttle body spacing block's aperture(s) serve to increase air charge velocity and turbinate the air charge. Accordingly, no further discussion relating to the manner of usage and operation will be provided.

The present invention utilizing a spacing block 12 interfaced with a throttle body or standard carburetor and a wet or dry intake manifold of an internal combustion engine. The example device creates a vortex-generated flow of air that atomizes the fuel mixture before entering the combustion chamber of said internal combustion engine.

With respect to the above description, it is to be realized that the optimum dimensional relationships for the present invention, to include variations in size, materials, shape, form, function and manner of operation, assembly, and use, are deemed readily apparent and obvious to one skilled in the art, and all equivalent relationships to those illustrated in the drawings and described in the specification are intended to be encompassed by the present invention.

Therefore, the foregoing is considered illustrative only of the use of the grooved aperture(s) within a throttle body spacing block. The grooved surface of the aperture(s) can be incorporated within a throttle body spacing block for any and all internal combustion engines. Since there are numerous internal combustion engines ranging from automobiles, all-terrain vehicles, motorcycles, diesels, recreational vehicles, it is not desired to limit the present invention to the exact construction and operation shown and described, and accordingly, all suitable modifications and equivalents may be resorted to, falling within the scope of the invention.

Conclusions, Ramifications, and Scope

Accordingly, it can be seen that the throttle body spacing block 12 incorporating the grooved aperture 10 can be installed on any and all internal combustion engines between the intake manifold and the throttle body, throttle body injection, or carburetor. The throttle body spacing block incorporating the grooved aperture 10 serves to increase the air charge velocity and to turbinate the air charge. This manipulation of the air charge improves gas mileage, lowers fuel emissions, and increases horsepower and torque beyond that of the prior art.

Thus, it is not the throttle body spacing block 12 itself that is unique to the art, but the incorporation of the grooved aperture 10 within said spacing block 12. It is the concept of the grooved aperture 10 that separates the present invention from the prior art not only in design and function but also in operation. The grooved aperture 10 manipulates the incoming air charge into a vortex. This unique feature is absent in the prior art. Further, the prior art has failed to expand the throttle body spacing block concept beyond the automobile. However, the present invention does not seek such a limitation but to incorporate the grooved aperture 10 within a throttle body spacing block 12 that is retrofitted for internal combustion engines of any size, make, model. The ultimate design of the throttle body spacing block 12 is dependent on application. This expands the scope of engines that benefit from the present invention.

Although the description above contains much specificity, this should not be construed as limiting the scope of the invention but as merely providing illustrations of some of the presently preferred embodiments of this invention. Various other embodiments and ramifications are possible within it's scope. For example, the scope of the invention should be determined by the appended claims and their legal equivalents, rather than by the examples given.

What is claimed is:

1. A throttle body spacing block which is adapted to be positioned and installed between the intake manifold and throttle body, throttle body injection unit, or carburetor for any and all internal combustion engines, comprising of an aperture throughout said spacing block for the passage of an incoming air charge with said aperture having an inlet and outlet openings, said aperture having formed along its interior surface a single, continuous thread pitch groove starting at the inlet opening and stopping at the outlet opening.

2. In a device as set forth in claim 1, said aperture(s) for the passage of the incoming air charge being cylindrical and surface of the aperture having a single, continuous thread pitch groove of 0.250" starting at the top of said inlet opening and stopping at the bottom of outlet opening, on the inlet side, the continuous thread pitch groove has an exposed flat surface, on the outlet side, the continuous thread pitch groove has a 45 degree tapered wall, the continuous thread pitch groove is helical in shape beginning at the outlet and ending at the outlet.

3. A throttle body spacing block which is adapted to be positioned and installed between the intake manifold and throttle body, throttle body injection unit, or carburetor for any and all internal combustion engines, comprising:

(a) a throttle body spacing block retrofitted for the specific internal combustion engine and constructed of rigid material having a thickness dependent on the application, a lower surface, an upper surface, and a peripheral edge there between:

(b) a cylindrical aperture or apertures, having inlet and outlet openings, formed through the throttle body spacing block, depending on the type and design of the internal combustion engine, with aperture interior surface having a straight bore minor diameter with a major diameter cut with a 45 degree flat bottom tooling set at 0.250 thread pitch, giving a helical shape from inlet to outlet, on the inlet side, the continuous thread pitch groove has an exposed flat surface, on the outlet side, the continuous thread pitch groove has a 45 degree tapered wall, chamfers at the top and bottom of said aperture of 45 degrees starting at the major diameter and ending at the minor diameter of the said helical shape.

4. A throttle body spacing block which is adapted to be positioned and installed between the intake manifold and throttle body, throttle body injection unit, or carburetor for any and all internal combustion engines, comprising:

(a) a throttle body spacing block retrofitted for the specific internal combustion engine and constructed of rigid material having a thickness dependent on the application, a lower surface, an upper surface, and a peripheral edge there between:

(b) a cylindrical aperture or apertures, having inlet and outlet openings, formed through the throttle body spacing block, depending on the type and design of the internal combustion engine, with aperture interior surface having a straight bore minor diameter with a major diameter cut with the a 45 degree flat bottom tooling set at a 0.250 thread pitch, giving a helical shape from inlet to outlet, a straight bore on the inlet opening having a diameter the same as the helix cut at a depth of 0.200 inch, on the inlet side, the continuous thread pitch groove has an exposed flat surface, on the outlet side, the continuous thread pitch groove has a 45 degree tapered wall, a 45 degree chamfer on the outlet set at the helical cut major diameter going down to a straight bore minor diameter.

* * * * *